US009160115B2

(12) United States Patent
Kao et al.

(10) Patent No.: US 9,160,115 B2
(45) Date of Patent: Oct. 13, 2015

(54) ELECTRICAL CONNECTOR PLUG HAVING A METALLIC SHIELD SURRONDING A FRONT EDGE OF THE PLUG

(71) Applicant: ADVANCED-CONNECTEK INC., New Taipei (TW)

(72) Inventors: Ya-Fen Kao, New Taipei (TW); Yu-Lun Tsai, New Taipei (TW); Pin-Yuan Hou, New Taipei (TW); Wen-Yu Wang, New Taipei (TW); Wen-Hsien Tsai, New Taipei (TW)

(73) Assignee: ADVANCED-CONNECTEK INC., New Taipei (TW)

( * ) Notice: Subject to any disclaimer, the term of this patent is extended or adjusted under 35 U.S.C. 154(b) by 0 days.

(21) Appl. No.: 14/285,614

(22) Filed: May 22, 2014

(65) Prior Publication Data

US 2015/0111428 A1 Apr. 23, 2015

(30) Foreign Application Priority Data

Oct. 18, 2013 (TW) ..... 102137773 A

(51) Int. Cl.

| | |
|---|---|
| ***H01R 13/658*** | (2011.01) |
| ***H01R 13/6596*** | (2011.01) |
| ***H01R 13/6581*** | (2011.01) |
| *H01R 13/504* | (2006.01) |
| *H01R 24/64* | (2011.01) |

(52) U.S. Cl.

CPC ..... *H01R 13/6596* (2013.01); *H01R 13/6581* (2013.01); *H01R 13/65802* (2013.01); *H01R 13/504* (2013.01); *H01R 24/64* (2013.01)

(58) Field of Classification Search

USPC ..... 439/607.01–607.59

See application file for complete search history.

(56) References Cited

U.S. PATENT DOCUMENTS

| | | | | |
|---|---|---|---|---|
| 2010/0068903 | A1* | 3/2010 | Chiang et al. | 439/79 |
| 2010/0278490 | A1* | 11/2010 | Liao et al. | 385/90 |
| 2015/0072557 | A1* | 3/2015 | Kamei et al. | 439/607.02 |
| 2015/0072565 | A1* | 3/2015 | Golko et al. | 439/676 |
| 2015/0111425 | A1* | 4/2015 | Kao et al. | 439/607.01 |

* cited by examiner

*Primary Examiner* — Chandrika Prasad

(57) ABSTRACT

An electrical connector plug has resilient contact terminals for electrical connection to an electrical connector socket. The electrical connector plug has an electrically conductive housing, and a dielectric shell and resilient contact terminals are mounted in the electrically conductive housing. The dielectric shell has a base portion and a front edge portion extending from the base portion. Two groups of resilient contact terminals are mounted on the dielectric shell and axially symmetrical to each other in the longitudinal direction, with each of the resilient contact terminals having a flat section and an upwardly protruding contact section. A metallic shield frame surrounds the front edge portion and is electrically connected to the electrically conductive housing, with the metallic shield frame having a front section and two lateral protective sections. The lateral protective sections have a height no less than that of the upwardly protruding contact sections.

11 Claims, 9 Drawing Sheets

ELECTRICAL CONNECTOR PLUG HAVING A METALLIC SHIELD SURRONDING A FRONT EDGE OF THE PLUG

FIELD OF THE INVENTION

The present invention relates to an electrical connector plug and conductive wire, and an assembly provided with the same.

BACKGROUND OF THE INVENTION

With the current prevalence of computers, people frequently connect various types of accessory devices to their computers so as to realize additional or desired functions. The most common of these accessory devices include external hard drives, portable disks, video and audio players, external power supplies, mice and keyboards. However, when multimedia computers initially came to rise, the manufacturers of these computers did not reach a consensus on the specifications for the transmission interfaces of these accessory devices. For example, many printers can only be connected to an LPT port; many MODEMs can only be connected to RS232 ports, several types of mice and keyboards can only connect to a PS/2 ports, and so on. Further, these different interface specifications often require the installation of corresponding drivers and then rebooting of the computing device prior to use. This can be a source of significant inconvenience to consumers in terms of use, and also increases difficulties for computer manufacturers and accessory manufacturers in terms of coordination.

With this background in mind, the Universal Serial Bus (USB) interface supports both hot swapping and plug-and-play features. Hot swapping means the USB accessory device can be directly plugged/unplugged when the computer is running with the appropriate software, and this hot-swapping will not damage the host or USB accessory devices. Plug-and-play means the computer can detect and use the newly plugged-in accessory device in real time without the need of rebooting. Moreover, USB speeds are typically much higher than that of traditional standard interfaces, such as parallel ports (e.g. EPP, LPT) and serial ports (e.g. RS-232). With the above advantages and market demands, USB has now become a popularly accepted specification.

To date, the development of USB technology has gone through three major phases, from version 1.0 to version 3.0. Since the original USB plug only fits one specific way in the USB socket, the USB socket can be damaged if the user inserts the USB plug in the wrong direction. Further, it is somewhat troublesome to change and maintain the USB socket built into a host computer. Therefore, a fool-proof structure has been provided to protect against such reverse plugging. However, this structure is still a source of inconvenience for the user despite the fact that reverse plugging is avoided. Therefore, the newest USB 3.0 plug is designed to be able to be engaged in both orientations (i.e., up and down). Inserted in either way, it can electrically connect to the socket, which improves the previous structural design which only fits one way.

Due to the inconvenience related to maintenance or repairs of a USB socket, users and manufacturers actively seek to protect the USB socket to eliminate such maintenance-related troubles. However, in addition to the above orientation problems, there are also some other factors that may damage USB sockets, such as the resilient contact terminals inside the socket. After coupling the USB plug, the resilient contact terminals in the USB socket are pressed back by the engaging terminals of the USB plug, and resist the insertion pressure to elastically abut against the engaging terminals without any gaps, thus maintaining the electrical connection between the USB socket and the USB plug stable.

However, USB 3.0 is more compact than the previous USB 1.0 or 2.0 versions, and as a result the structure of the resilient contact terminals is more delicate and fine due to the greater numbers. If the resilient contact terminals are pressed improperly or used for a long time, the structure may be deformed, which can cause elastic fatigue or displacement. This can lead to gaps, interruption in the electrical connections between the engaging terminals and the resilient contact terminals, and reduction in the effectiveness of the USB accessory device. Additionally, many situations require using multiple USB accessory devices collaboratively. For example, clearing and sorting redundant or disordered data in a computer using an external hard drive requires three objects: the mouse, keyboard and external hard drive. In case of malfunction on any USB socket, the user must give up one of these three devices. Consequently, the user cannot finish the desired goal using an external hard drive. Some accessory devices also have large power requirements, and so they can occupy two neighboring USB sockets. If one of these sockets is broken, it can be a source of great inconvenience to the computer operator.

To continue to back up and clear the data in the computer, most users are forced to consider replacing the damaged USB socket. However, it is quite difficult for the users to change a USB socket because it requires disassembling the computer and checking the motherboard. Moreover, this kind of repair may take several days. Nowadays, people rely on computers to such a degree that they may feel it is not worth it to spend so much time on a small component, which would delay their work or entertainment.

SUMMARY OF THE INVENTION

Embodiments of the invention provide an electrical connector plug and conductive wire, and an assembly provided with the same. The resilient electrical contact terminals are prevented from becoming a source of weaknesses of the USB plug. Various embodiments also provide protection to support the resilient contact terminals, so as to prevent structural damage due to excessive pressure. Such embodiments reduce the probability of malfunction of the resilient contact terminals. Even if they are accidentally damaged, the user can change them easily, so as to save both time and effort otherwise wasted by returning the host device to the manufacturer for maintenance.

Another aspect of embodiments of the invention is to provide an electrical connector plug and conductive wire, and an assembly provided with the same, which mounts the vulnerable resilient contact terminals on the USB plug so as to solve the problems of existing USB connectors, such as difficulty in replacement and related and wasting of time.

Another purpose of various embodiments of the invention is to provide an electrical connector plug and conductive wire, and an assembly provided with the same, which adds a metallic shield frame to the USB plug to provide additional protection for the vulnerable resilient contact terminal and that absorbs excessive external forces on the metallic shield frame. In this way, the metallic shield reduces the probability of structural damage to the resilient contact terminals due to external forces.

Another purpose of various embodiments of the invention is to provide an electrical connector plug and conductive wire, and an assembly provided with the same, which adds a metallic shield frame to the USB plug to provide crosstalk protection.

To achieve these and other purposes, various embodiments provide an electrical connector plug with resilient contact terminals adapted for an electrical connection socket, wherein the electrical connector socket includes a casing and at least two groups of engaging terminals mounted on the casing. The electrical connector plug comprises an electrically conductive housing, and a dielectric shell coupled to the electrically conductive housing and extending along a longitudinal direction. The dielectric shell includes a base portion and a front edge portion extending from the base portion along the longitudinal direction. The base portion and the front edge portion cooperatively define an engagement space. At least two groups of resilient contact terminals are mounted on the dielectric shell and are axially symmetrical to each other in the longitudinal direction, with each of the resilient contact terminals having a flat section secured at least in part to the base portion of the dielectric shell and an upwardly protruding contact section extending from and bending towards the flat section. The flat sections are parallel to one another and the respective upwardly protruding contact sections are adapted to abut against a corresponding one or more of the engaging terminals of the electrical connector socket and have an end portion held in position by the front edge portion. A metallic shield frame surrounds the front edge portion and is electrically connected and secured to the electrically conductive housing, with the metallic shield frame having a front section and two lateral protective sections respectively extending from two ends of the front section and bent to surround the front edge portion. The respective lateral protective sections have a height no less than that of the upwardly protruding contact sections of the resilient contact terminals.

The electrical connector plug can be connected to at least one end of a connecting wire, namely, a conductive wire, which provides electrical connection to an electrical connector socket having a casing and at least two groups of engaging terminals mounted in the casing. The conductive wire has at least one electrical connector plug; and at least one wire electrically connected to the electrical connector plug. The electrical connector plug includes an electrically conductive housing and a dielectric shell mounted on the electrically conductive housing and extending along a longitudinal direction. The dielectric shell has a base portion and a front edge portion extending from the base portion along the longitudinal direction. The base portion and the front edge portion cooperatively define an engagement space. At least two groups of resilient contact terminals are coupled to the dielectric shell and are axially symmetrical to each other in the longitudinal direction. Each of the resilient contact terminals has a flat section secured at least to part in the base portion of the dielectric shell and an upwardly protruding contact section extending from the flat section. The flat sections are parallel to one another. The respective upwardly protruding contact sections are adapted to abut against a corresponding one or more of the engaging terminals of the electrical connector socket and have an end portion held in position by the front edge portion. A circuit board is used to electrically connects the flat sections of the resilient contact terminals to the wire. A metallic shield frame surrounds the front edge portion and is electrically connected to and secured to the electrically conductive housing. The metallic shield frame has a front section and two lateral protective sections respectively extending from two ends of the front section and bent to surround the front edge portion. The respective lateral protective sections have a height no less than that of the upwardly protruding contact sections of the resilient contact terminals.

The electrical connector plug together with the socket provides an electrical connector assembly, which includes an electrical connector socket having a casing and at least two groups of engaging terminals mounted on the casing, and an electrical connector plug electrically connected to the electrical connector socket. The electrical connector plug includes an electrically conductive housing and a dielectric shell coupled to the electrically conductive housing and extending along a longitudinal direction. The dielectric shell has a base portion and a front edge portion extending from the base portion along the longitudinal direction. The base portion and the front edge portion cooperatively define an engagement space. At least two groups of resilient contact terminals are mounted on the dielectric shell and are axially symmetrical to each other in the longitudinal direction, with each of the resilient contact terminals having a flat section secured at least in part in the base portion of the dielectric shell and an upwardly protruding contact section extending from and bent towards the flat section. The flat sections are parallel to one another and the respective upwardly protruding contact sections are adapted to abut against a corresponding one or more of the engaging terminals of the electrical connector socket and have an end portion held in position by the front edge portion. A metallic shield frame surrounds the front edge portion and is electrically connected to and secured to the electrically conductive housing. The metallic shield frame has a front section and two lateral protective sections respectively extending from two ends of the front section and bent to surround the front edge portion. The respective lateral protective sections have a height no less than that of the upwardly protruding contact sections of the resilient contact terminals.

The electrical connector plug and conductive wire and assembly provided with same disclosed in this case mounts the resilient electrically conductive terminals of the USB socket on the USB plug, and provides a metallic shield frame to support the resilient contact terminals, preventing elasticity loss due to excessive pressure. In this way, additional protection is provided for the resilient contact terminals of the USB plug, so that they will not be easily damaged. Even if damaged, the user does not have to take the host computer in for repair, but simply needs to change the spare USB accessories, or even the conductive wire only. In this respect, the structure improves upon a significant drawback of the previous USB sockets and increases durability, eliminating the trouble of repair by the manufacturer.

BRIEF DESCRIPTION OF THE DRAWINGS

The foregoing and other features and advantages of illustrated embodiments of the present invention will be more readily apparent from the following detailed description, which proceeds with reference to the accompanying drawings.

DETAILED DESCRIPTION OF THE ILLUSTRATED EMBODIMENTS

The above statements related to embodiments of the invention, other technical aspects, features and benefits will be clearly presented in the detailed illustration for the preferred embodiments as shown in the diagrams. The embodiments of this case take a USB connector as examples. However, the technology of this case is not limited to the USB connectors, and can also be applied to other related products and connectors.

Figure 1:
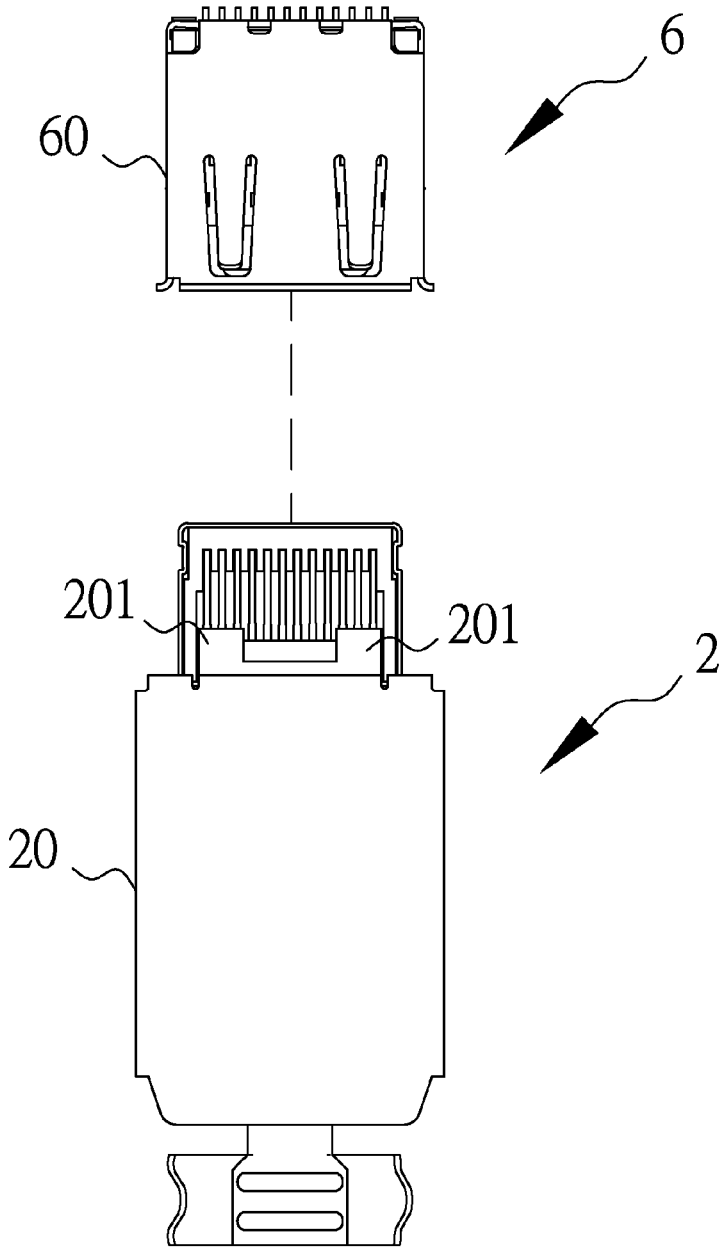
FIG. 1 is a top view of a first embodiment of the invention, illustrating contact between an electrically conductive lip and a casing when an electrical connector plug is connected to a socket.
Figure 2:
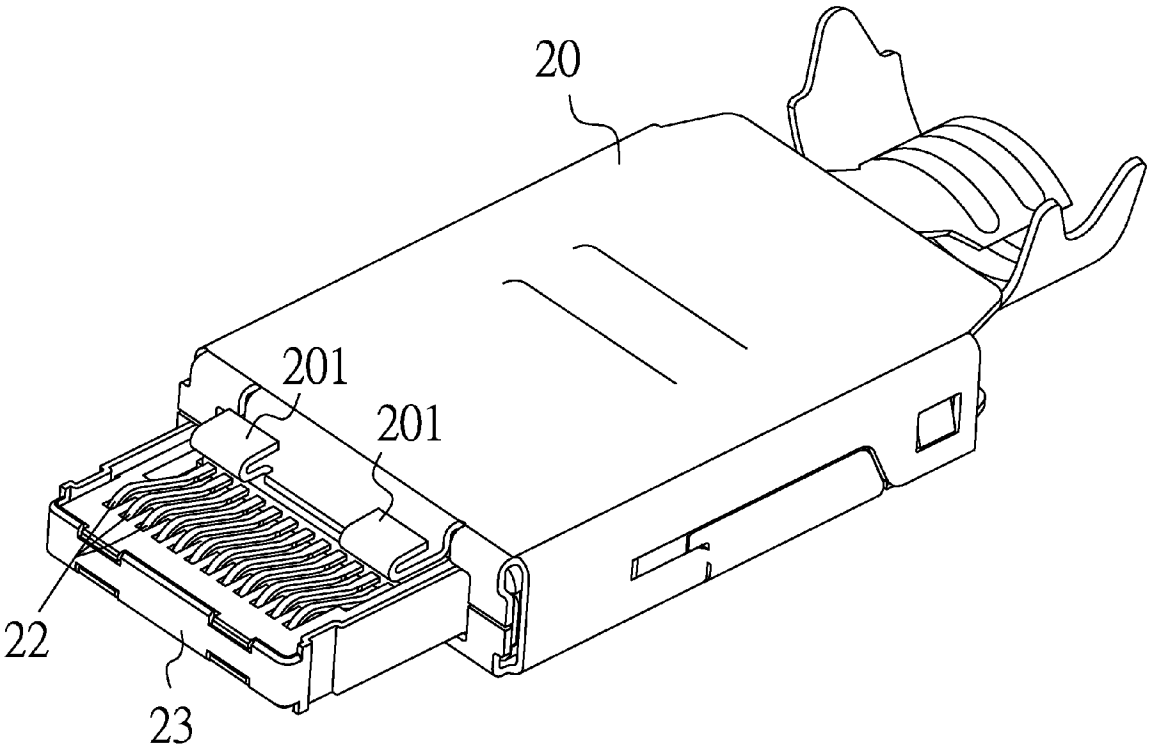
FIG. 2 is the perspective diagram of the first preferred embodiment, illustrating structure of the resilient contact terminals.

The first preferred embodiment of the invention is an electrical connector assembly, as shown in FIGS. 1 and 2. The electrical connector assembly is a USB connector assembly in this embodiment, having an electrical connector socket 6, which is a USB socket, and an electrical connector plug 2, which is a USB plug. When they are coupled and electrically connected together, an electrically conductive housing 20 of the electrical connector plug 2 is electrically connected to a casing 60 of the electrical connector socket 6 through at least one electrically conductive lip 201. The casing 60 can be mounted on the motherboard or shell of an electronic device, such as a computer. In this way, the electrical connector plug 2 obtains grounding and shielding effects when connected to the whole product.

Figure 3:
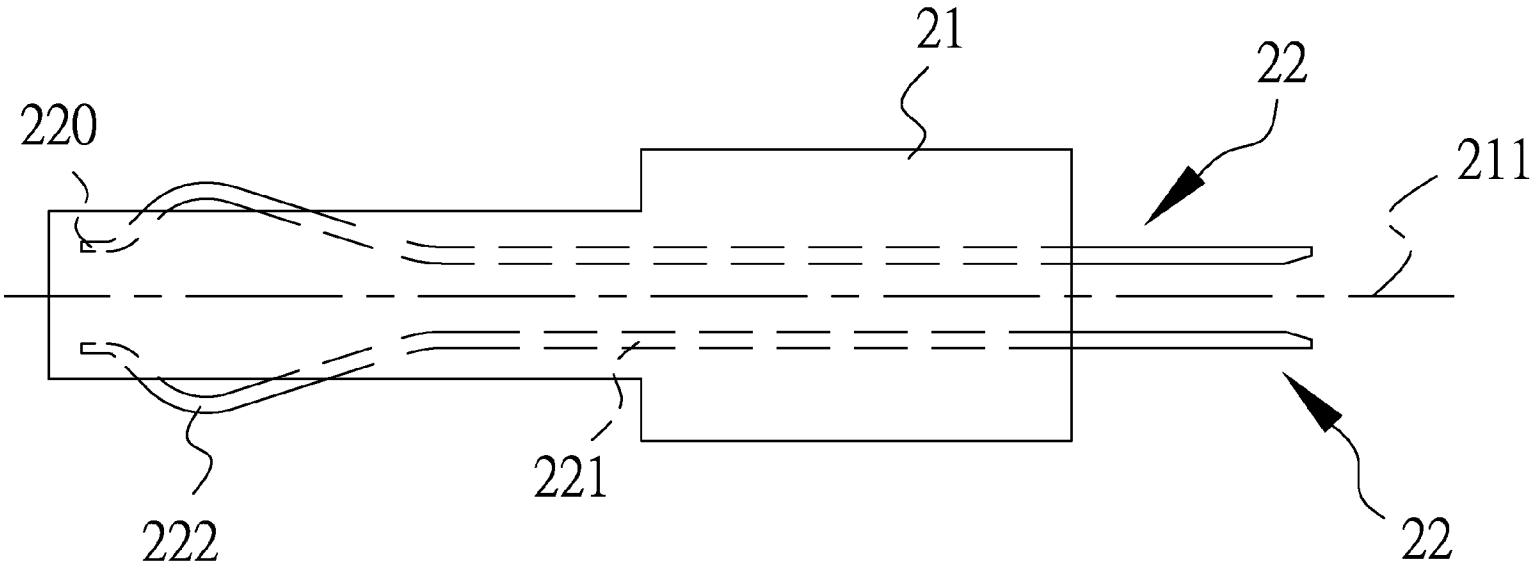
FIG. 3 is the block diagram of the electrical connector plug of the first preferred embodiment.
Figure 4:
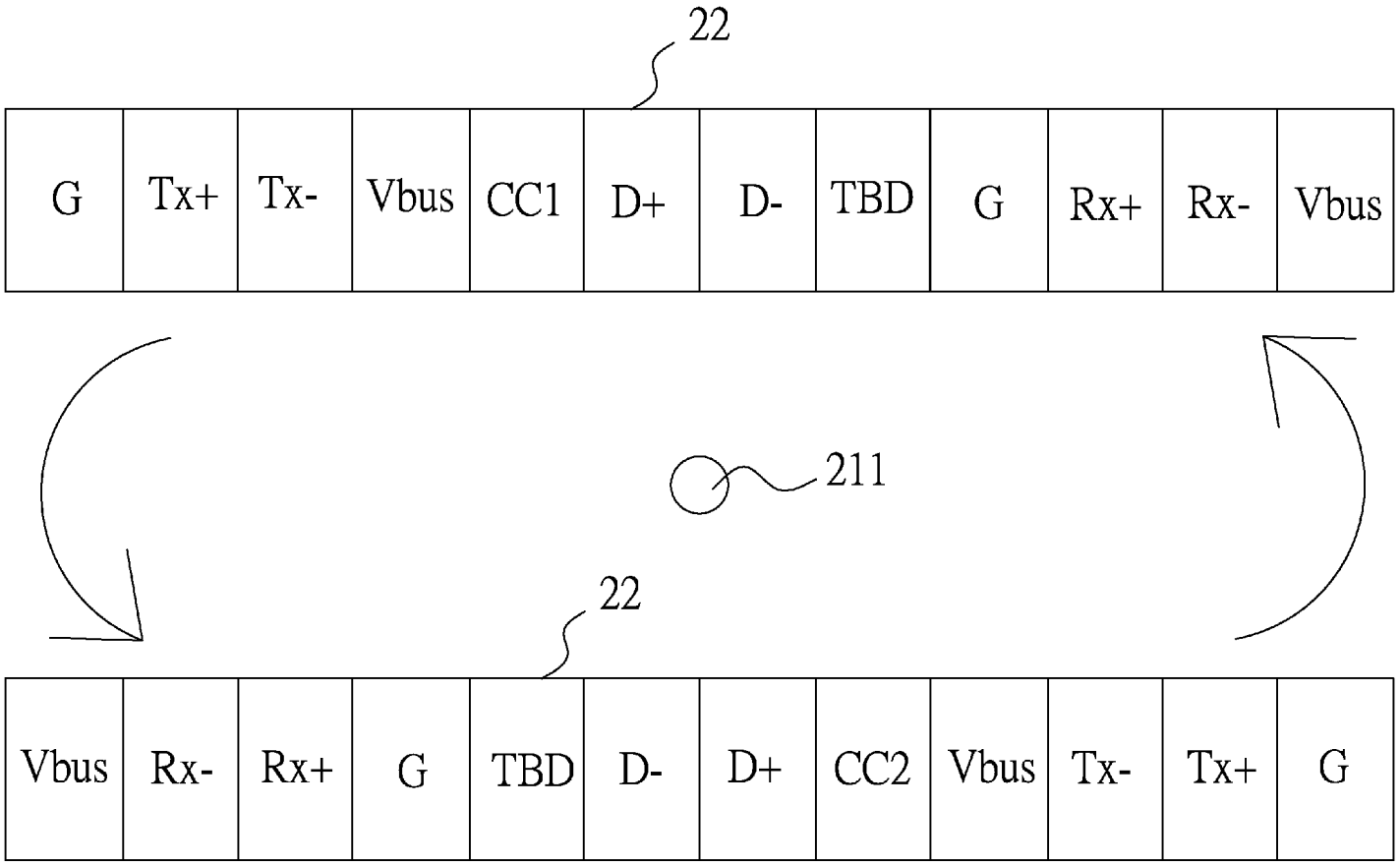
FIG. 4 illustrates an axially symmetrical arrangement of two groups of resilient contact terminals in the first embodiment of the invention.

Moreover, as shown in FIGS. 3 and 4, the electrical connector plug 2 has two groups of resilient contact terminals 22 mounted in or on the dielectric shell 21 under the wire on both sides. When viewed from the front side of the electrical connector plug, as shown in FIG. 4, it can be found that the two groups of secured resilient contact terminals 22 are symmetrical to each other, wherein either group of resilient contact terminals 22 is completely overlapped with another group by rotating 180 degrees with the central axis as pivot. The central axis defines a longitudinal direction 211. Axial symmetry along the longitudinal direction 211 is used to define the mounting positions of the two groups of resilient contact terminals 22.

Figure 5:
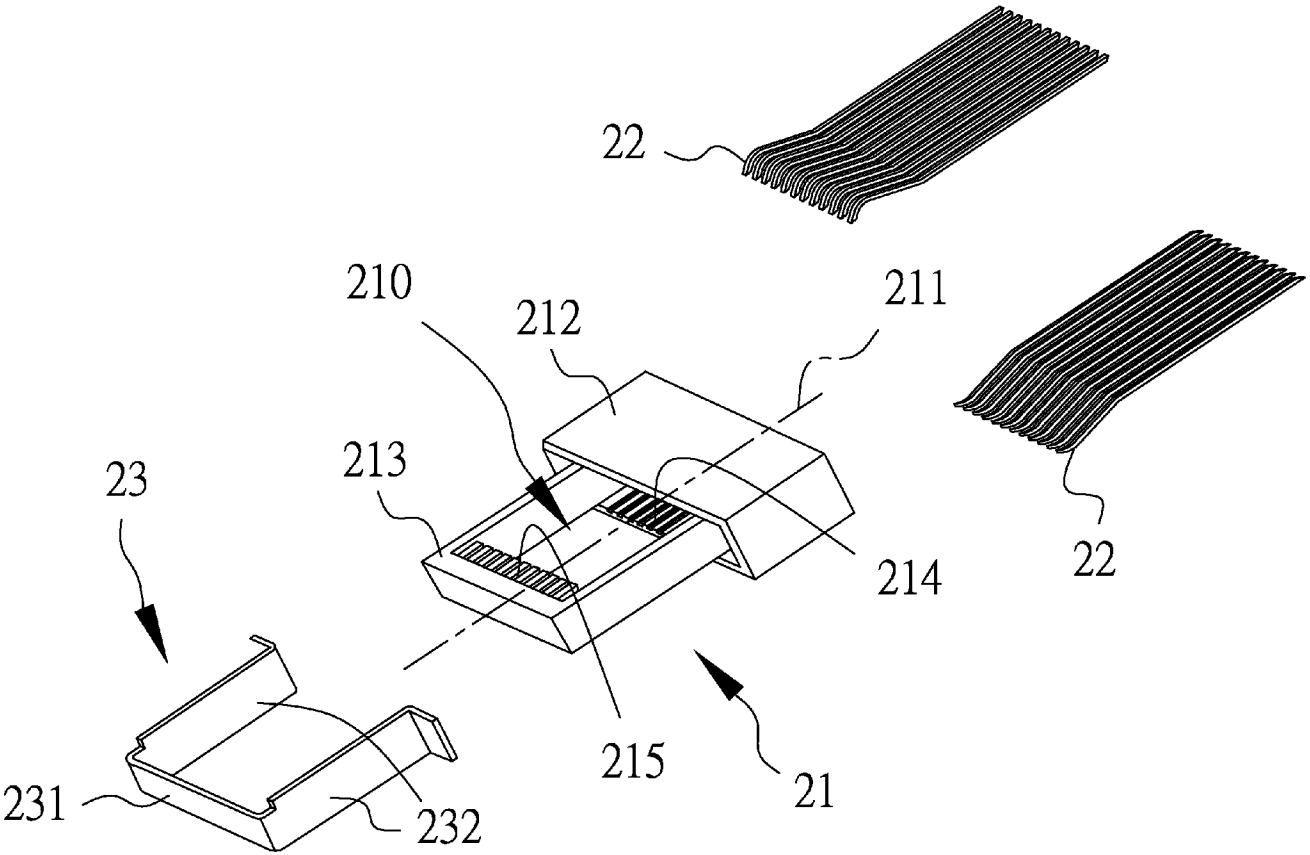
FIG. 5 is an exploded view illustrating connection between resilient contact terminals, a dielectric shell and a metallic shield frame.

As shown in FIGS. 3 and 5, the dielectric shell 21 extends along the longitudinal direction 211, on which the two groups of resilient contact terminals 22, axially symmetrical to one another, are secured. Each group of resilient contact terminals 22 includes multiple metallic pins which are parallel to one another, extending horizontally and forming a bent shape. The horizontally extending section provides flat section 211, while the bent section provides upwardly protruding contact section 222. A part of the dielectric shell 21 is formed with a plurality of guide grooves 214 to receive and secure the flat sections 221, which provides a base portion 212 of the dielectric shell 21. A further portion of the base portion 212 that extends from the base portion 212 along the longitudinal direction 211 provides a front edge portion 213, which is formed with a plurality of guide portions 215 for holding end portions 220 of the upwardly protruding contact sections 222. Each metallic pin of the resilient contact terminals 22 is received by the guide grooves 214 and guide portions 215, preventing crossing that can otherwise cause short circuits.

Moreover, the base portion 212 and the front edge portion 213 cooperatively define an engagement space 210, and the two groups of axially symmetrical upwardly protruding contact sections are exposed in the engagement space 210. In addition, as shown in FIGS. 2 and 5, a metallic shield frame 23 surrounds the front edge portion 213, and is electrically connected to and secured to the electrically conductive housing 20. In this way, metallic shield frame 23 reduces the probability of crosstalk between the signals of different connectors. The sections of the metallic shield frame 23 located on both sides of the front edge portion 213 have a special function, and provide two lateral protective sections 232. The lateral protective sections 232 respectively bend from two ends of the section of the metallic shield frame 23 located on the front side of the front edge portion 213. Therefore, the section on the front side of the corresponding front edge side 213 is defined as the front section 231.

Figure 6:
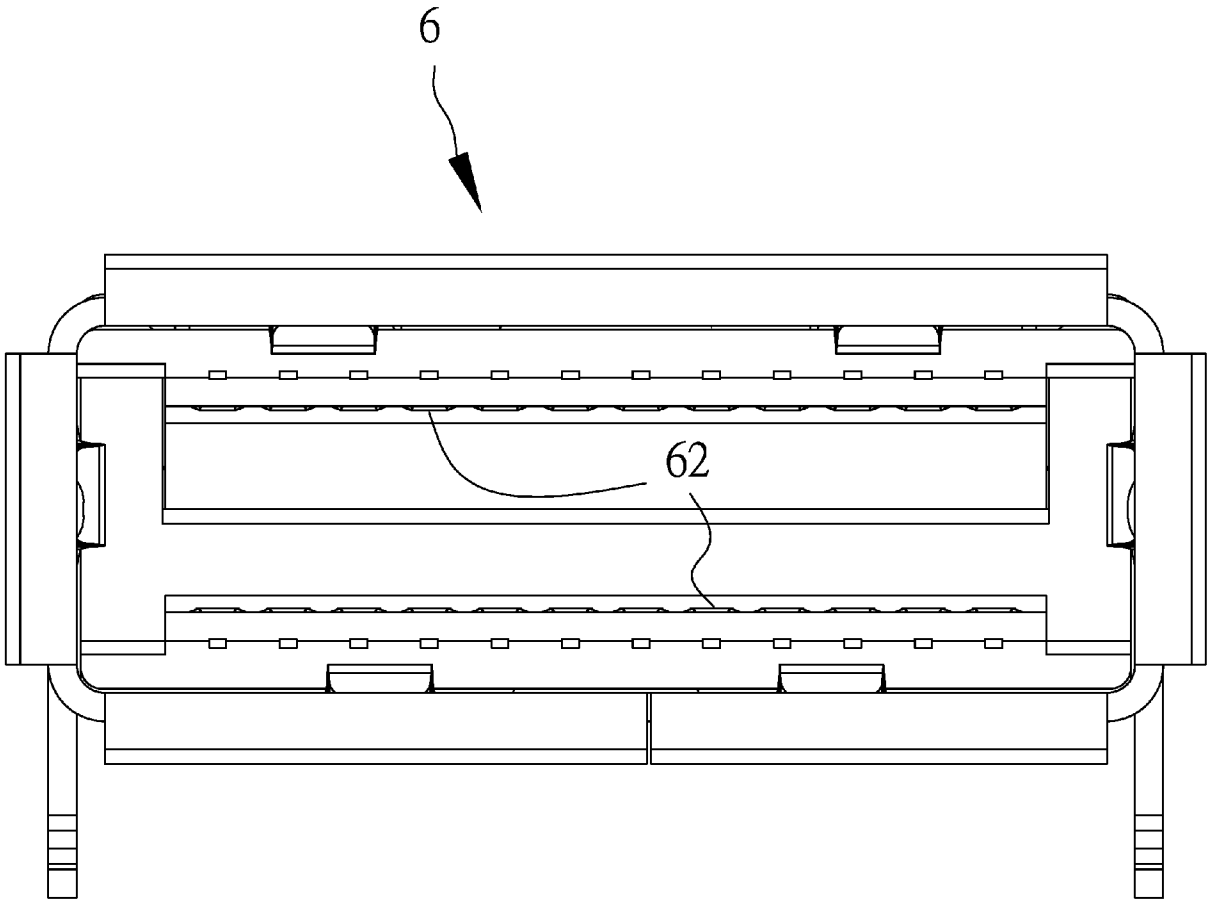
FIG. 6 is a front view of an electrical connector socket according to a first embodiment of the invention.

The height of the front section 231 is less than that of the upwardly protruding contact section 222 and the lateral protective sections 232. The height of the lateral protective sections 232 on both sides is no less than that of the upwardly protruding contact section 222. In this way, in a normal configuration, the two groups of engaging terminals 62 of the electrical connector socket 6, as shown in FIG. 6, will go through the front section 231 with a lower height, and enter the engagement space 210 to abut against and electrically connect to the resilient contact terminals 22. In case of overforcing, or if the casing 60 of the whole electrical connector socket 6 is too narrow, the coupled electrical connector plug 2 will be pressed by a large external force. Then, the resultant excessive pressure will be resisted by the lateral protective sections 232 to prevent the force from further pressing the upwardly protruding contact section 222, which would otherwise cause structural damage.

Through the above structure, it can be seen that at least two effects are obtained. Firstly, reduction in damage is provided. The delicate and vulnerable resilient contact terminals are transferred to the electrical connector plug, and will not have an impact on the stable electrical connection between the electrical connector plug and the electrical connector socket. Moreover, the electrical connector plug is not built into the computer or the accessory device, and so can be replaced by the user at a lower cost. If the user has a spare electrical connector plug then changing it requires very little time indeed. These features greatly improve replacement of the resilient contact terminals, which are thereby changed into consumable parts. In this way, the negative impact brought by damage to the resilient contact terminals is significantly reduced.

Secondly, a baseline for force exertion is provided. Some extent of pressure on the upwardly protruding contact section is permitted. While protecting the resilient contact terminals, the lateral protective sections do not block the engaging terminals abutting against the upwardly protruding section, and so does not impact stable electrical connection. Further, the electrical connector plug can be manufactured and sold independently or together with the related products, such as a portable disk. The electrical connector plug for a portable disk and the electrical connector socket for a computer on the market belong to different electronics manufacturers and sellers.

Figure 7:
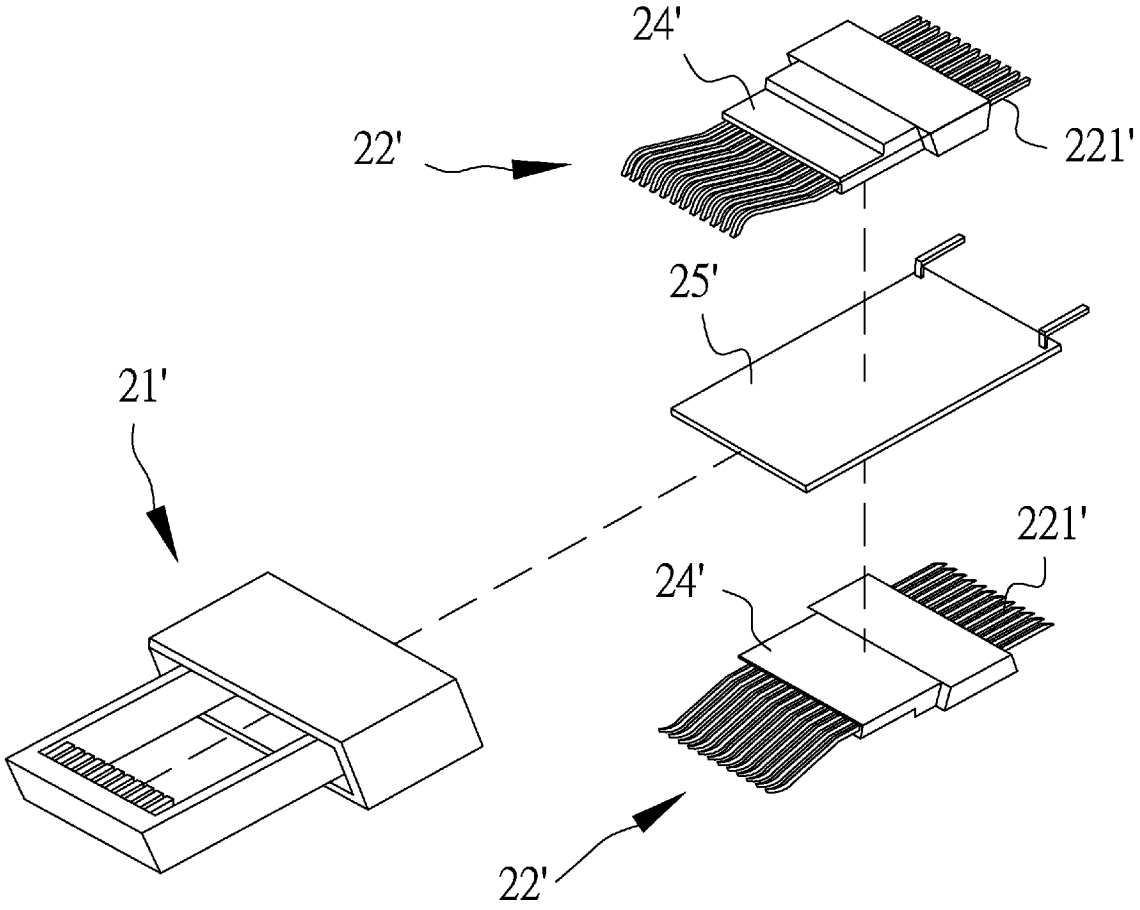
FIG. 7 is an exploded view of a second embodiment, illustrating a holder member and a grounding plate.
Figure 8:
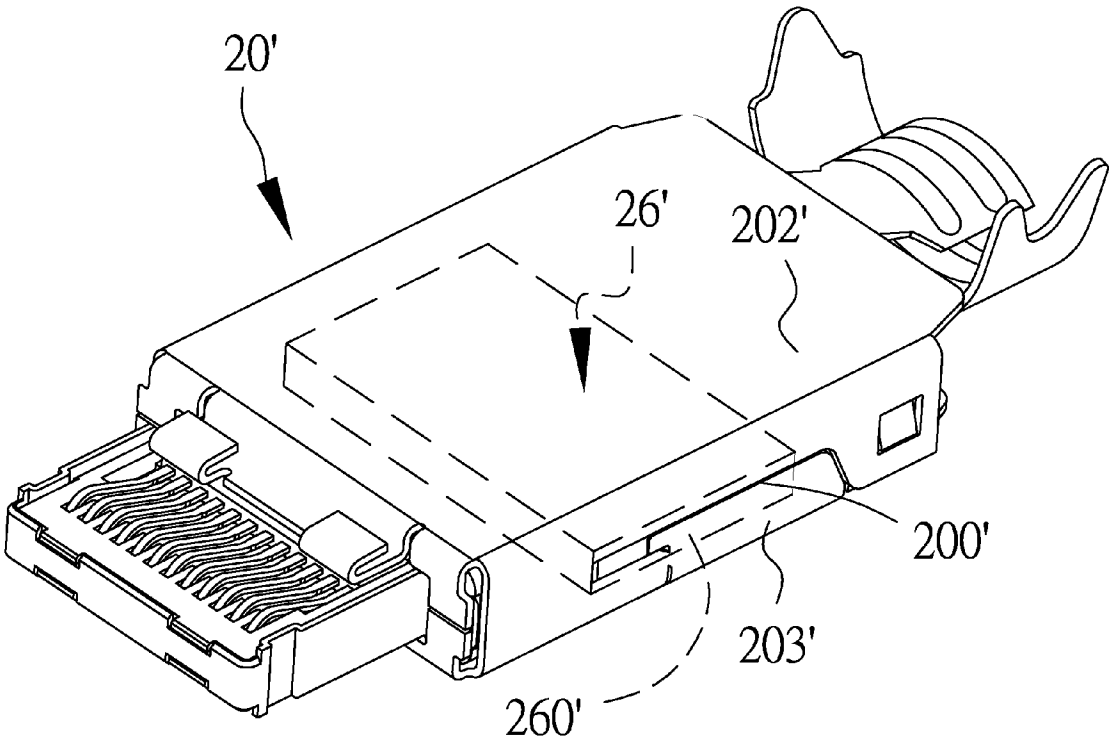
FIG. 8 is a perspective view of the second preferred embodiment, illustrating a single bonding operation between the circuit board and upper and lower housings.

The second preferred embodiment is shown in FIGS. 7 and 8. In contrast to the first embodiment in which the flat sections are secured by the guide grooves of the dielectric shell, this embodiment uses a holder member 24' to hold the flat sections 221' of the two groups of resilient contact terminals 22' in position, so as to maintain the axially symmetrical arrangement, which are then disposed in the dielectric shell 21'. The holder member 24' and the resilient contact terminals 22' secured to it can be assembled in an upstream production chain or in prior assembly steps. When connected to the dielectric shell 21', the holder member 24' eliminates the trouble of aligning and mounting the resilient contact terminals 22' on the guide grooves, so as to accelerate the assembly process and improve production efficiencies. Moreover, a grounding plate 25' can be disposed between the two groups of resilient contact terminals 22', so as to block electromagnetic radiation and avoid crosstalk between the two groups of resilient contact terminals 22'.

In addition, the electrically conductive housing 20' can include an upper housing 202' and a lower housing 203'. The conjunctions on both sides between the upper housing 202' and the lower housing 203' provide bonding spots 200'. A circuit board 26' disposed in the electrically conductive housing 20' is used for electrical connection to the flat sections 221'. The circuit board 26' includes a front side, a back side and two lateral sides 260' connecting the front side to the back side and corresponding to the two bonding spots 200'. Bonding in the prior art required two steps: firstly, welding or soldering the two lateral sides 260' of the circuit board 26' to the electrically conductive housing 20', and then welding or soldering the upper housing 202' to the lower housing 203'. However, with the embodiment structure, solder only needs to be put on the bonding spots 200' to finish the welding or soldering in a single step since the lateral sides 260' of the circuit board 26' connected to the upper housing 202' and lower housing 203' corresponding to the bonding spots 200'. In this way, time related to the welding or soldering operation is reduced by half, and the structural stability and grounding effect of the product is strengthened.

Figure 9:
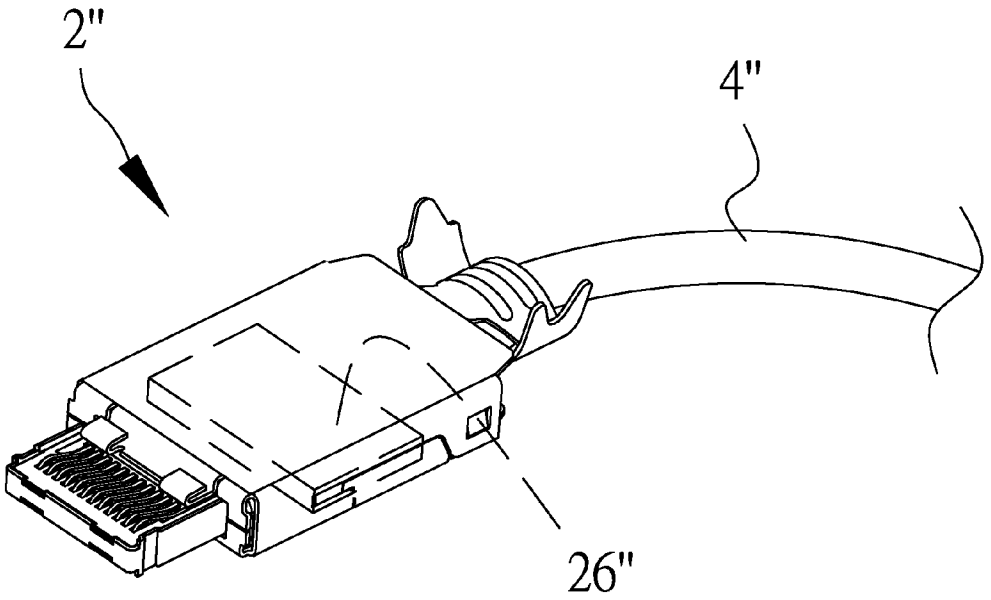
FIG. 9 is a perspective view of a third embodiment, illustrating a conductive wire of an electrical connector connecting the wire and a circuit board.

Those having ordinary skill in the art will readily recognize that the electrical connector plug in any embodiment can be made with or provided in products in related fields, such as conductive cables adapted for an electrical connector, as provided in the third preferred embodiment shown in FIG. 9. A circuit board 26" is mounted on the electrical connector plug 2". The circuit board connects with the flat sections on one end, and connects with a conductive wire 4" on the other end, so that the flat sections and the wire 4" are electrically connected to provide a conductive wire adapted for en electrical connector. The core technology of the product like this type is just a minor modification based on the technology disclosed herein and belongs within the claimed scope.

In summary, various embodiments mount the resilient contact terminals on the electrical connector plug, together with a metallic shield frame formed by metallic casting, to provide protection against pressure and crosstalk and to change the resilient contact terminals and the electrical connector plug to consumable parts. The user can easily change the plug by himself, saving the time and expense spent on taking a host product in for repair. This structure reduces the impact induced by damage to the resilient contact terminals, and reduces the probability of damage to the resilient contact terminals due to external forces or crosstalk interference.

While the invention has been described with reference to the preferred embodiments above, it should be recognized that the preferred embodiments are given for the purpose of illustration only and are not intended to limit the scope of the present invention, and that various modifications and changes, which will be apparent to those skilled in the relevant art, may be made without departing from the spirit and scope of the invention.

What is claimed is:

1. An electrical connector plug provided with resilient contact terminals and adapted for electrical connection to an electrical connector socket having a casing and at least two groups of engaging terminals mounted in the casing, the electrical connector plug comprising:

an electrically conductive housing;

a dielectric shell coupled to the electrically conductive housing and extending along a longitudinal direction, the dielectric shell comprising a base portion and a front edge portion extending from the base portion along the longitudinal direction, wherein the base portion and the front edge portion cooperatively define an engagement space;

at least two groups of resilient contact terminals mounted in the dielectric shell and axially symmetrical to each other about the longitudinal direction, each of the resilient contact terminals comprising a flat section secured at least in part in the base portion of the dielectric shell and an upwardly protruding contact section extending from the flat section, wherein the flat sections are parallel to one another and the respective upwardly protruding contact sections are adapted to abut against a corresponding one or more of the engaging terminals of the electrical connector socket and have an end portion held in position by the front edge portion; and a metallic shield frame surrounding the front edge portion and electrically connected to and secured to the electrically conductive housing, the metallic shield frame comprising a front section having two ends and two lateral protective sections respectively extending from the two ends of the front section and bent to surround the front edge portion, wherein the respective lateral protective sections each have a height no less than that of the upwardly protruding contact sections of the resilient contact terminals.

2. The electrical connector plug provided with resilient contact terminals according to claim 1, wherein the electrically conductive housing is provided with at least one electrically conductive lip for electrical connection to the casing of the electrical connector socket when the electrical connector plug is coupled to the electrical connector socket.

3. The electrical connector plug provided with resilient contact terminals according to claim 1, further comprising a holder member for holding the flat sections of the resilient contact terminals in position.

4. The electrical connector plug provided with resilient contact terminals according to claim 1, further comprising a grounding plate disposed between the two groups of resilient contact terminals.

5. The electrical connector plug provided with resilient contact terminals according to claim 1, wherein the electrical connector plug is compatible with a universal serial bus plug.

6. The electrical connector plug provided with resilient contact terminals according to claim 1, further comprising a circuit board for electrical connection to the flat sections of the resilient contact terminals, and wherein the circuit board includes a front side, a back side and at least two lateral sides connecting the front side to the back side.

7. The electrical connector plug provided with resilient contact terminals according to claim 6, wherein the electrically conductive housing comprises an upper housing and a lower housing, each being formed with at least two bonding spots, and wherein the bonding spots are formed in a manner corresponding to the at least two lateral sides of the circuit board, so that the upper housing, the lower housing and the circuit board are bonded together using the bonding spots.

8. The electrical connector plug provided with resilient contact terminals according to claim 1, wherein the base portion of the dielectric shell is formed with a plurality of guide grooves to receive the flat sections of the resilient contact terminals, and wherein the front edge portion of the dielectric shell is formed with a plurality of guide portions for holding the end portions of the upwardly protruding contact sections of the resilient contact terminals.

9. The electrical connector plug provided with resilient contact terminals according to claim 1, wherein the height of the lateral protective sections of the metallic shield frame is no less than that of the front section to provide protection to the upwardly protruding contact sections of the resilient contact terminals.

10. A conductive cable for electrical connection to an electrical connector socket having a casing and two groups of engaging terminals mounted in the casing, the conductive cable comprising:

at least one electrical connector plug; and at least a wire electrically connected to the at least one electrical connector plug;

wherein the at least one electrical connector plug comprises:

an electrically conductive housing;

a dielectric shell mounted in the electrically conductive housing and extending along a longitudinal direction, the dielectric shell comprising a base portion and a front edge portion extending from the base portion along the longitudinal direction, wherein the base portion and the front edge portion cooperatively define an engagement space;

at least two groups of resilient contact terminals mounted in the dielectric shell and axially symmetrical to each other about the longitudinal direction, each of the resilient contact terminals comprising a flat section secured at least in part in the base portion of the dielectric shell and an upwardly protruding contact section extending from the flat section, wherein the flat sections are parallel to one another and the respective upwardly protruding contact sections are adapted to abut against a corresponding one or more of the engaging terminals of the electrical connector socket and have an end portion held in position by the front edge portion;

a circuit board electrically connecting the flat sections of the resilient contact terminals to the at least a wire; and a metallic shield frame surrounding the front edge portion and electrically connected to and secured to the electrically conductive housing, the metallic shield frame comprising a front section having two ends and two lateral protective sections respectively extending from the two ends of the front section and bent to surround the front edge portion, wherein the respective lateral protective sections have a height no less than that of the upwardly protruding contact sections of the resilient contact terminals.

11. An electrical connector assembly comprising:

an electrical connector socket comprising a casing and at least two groups of engaging terminals mounted in the casing; and an electrical connector plug electrically connected to the electrical connector socket, comprising:

an electrically conductive housing;

a dielectric shell mounted in the electrically conductive housing and extending along a longitudinal direction, the dielectric shell comprising a base portion and a front edge portion extending from the base portion along the longitudinal direction, wherein the base portion and the front edge portion cooperatively define an engagement space;

at least two groups of resilient contact terminals mounted in the dielectric shell and axially symmetrical to each other about the longitudinal direction, each of the resilient contact terminals comprising a flat section secured at least in part in the base portion of the dielectric shell and an upwardly protruding contact section extending from the flat section, wherein the flat sections are parallel to one another and the respective upwardly protruding contact sections are adapted to abut against a corresponding one or more of the engaging terminals of the electrical connector socket and have an end portion held in position by the front edge portion; and a metallic shield frame surrounding the front edge portion and electrically connected to and secured to the electrically conductive housing, the metallic shield frame comprising a front section having two ends and two lateral protective sections respectively extending from the two ends of the front section and bent to surround the front edge portion, wherein the respective lateral protective sections have a height no less than that of the upwardly protruding contact sections of the resilient contact terminals.

* * * * *